US005213221A

United States Patent [19]

Raye, Sr.

[11] Patent Number: 5,213,221

[45] Date of Patent: May 25, 1993

[54] FOLDABLE DRYING RACK

[75] Inventor: Charles E. T. Raye, Sr., 68 Garden St., Stamford, Conn. 06902

[73] Assignee: Charles E. T. Raye, Sr., Research Triangle Park, N.C.

[21] Appl. No.: 403,191

[22] Filed: Sep. 5, 1989

[51] Int. Cl.[5] ..... A47B 43/00

[52] U.S. Cl. ..... 211/195; 211/181

[58] Field of Search ..... 211/181, 198, 200, 195; 248/514

[56] References Cited

U.S. PATENT DOCUMENTS

| | | | |
|---|---|---|---|
| 25,737 | 10/1959 | Holmes . | |
| 76,862 | 4/1868 | Wheaton | 211/198 |
| 1,894,176 | 1/1933 | Hirsch | 211/198 |
| 2,274,772 | 3/1942 | Bitney | 211/198 |
| 3,802,112 | 4/1974 | Banner | 248/514 X |
| 4,267,931 | 5/1981 | Belotta | 211/181 X |
| 4,807,766 | 2/1989 | Campagnucci | 211/198 |

FOREIGN PATENT DOCUMENTS

| | | | |
|---|---|---|---|
| 2719771 | 11/1977 | Fed. Rep. of Germany . | |
| 93736 | 2/1960 | Netherlands | 211/200 |
| 8703918 | 7/1987 | PCT Int'l Appl. | 211/200 |
| 355760 | 9/1961 | Switzerland . | |
| 887621 | 1/1962 | United Kingdom . | |

*Primary Examiner*—Blair M. Johnson
*Attorney, Agent, or Firm*—John H. Crozier

[57] ABSTRACT

A foldable drying rack having a rectangular midframe with side and end rails and hanging rails extending between the end rails. Hinged, foldable legs members extend downward from the ends of the midframe and provide support without having to loosen and tighten any fasteners. A shelf having hanging rails may be extended between the leg members below the midframe. Hinged, foldable rectangular wingframes, having hanging rails extending between the side rails may extend outward from the ends of the midframe and may also be deployed without having to loosen and tighten any fasteners. The windframes may also be folded inward toward each other and joined to form a tent-like structure above the midframe. The drying rack may be deployed in its unfolded position without the need to loosen and/or tighten fasteners. In one embodiment, a ratio of almost 10:1 in terms of lineal feet of hanging rails per square foot of floor space is achieved.

13 Claims, 5 Drawing Sheets

FOLDABLE DRYING RACK

BACKGROUND OF THE INVENTION

1. Field of the Invention

The present invention relates to the drying of wet articles generally and, more particularly, to a novel dryer in the form of a portable rack upon which, for example, wet clothes can be hung for drying and which rack, although foldable to a very compact form, provides a total length of clothes hanging means which is on the order of almost 10 times the floor area taken by the rack, in terms of lineal feet per square foot.

2. Background Art

In many confined living quarters, such as apartments and boats, for example, outdoor drying lines or wash lines are limited or unavailable and, in many cases, are actually prohibited. For these reasons, residents of such living quarters have a need for a portable drying rack on which wet clothes are hung for drying. Such a rack may be used indoors within the apartment or boat or outdoors on a balcony, patio, or deck. The unit must be stable in use and portable so that it can be conveniently moved from one place to another and should fold conveniently for storage in a small area.

A number of indoor drying racks have been designed and are on the market but they all have one or another of various drawbacks. For example, many of them will not hold a full load of clothes taken from a clothes washer. Others are not conveniently foldable for storage and still others are unduly expensive or unstable in use. None is known which conveniently provides for the drying of sweaters the heavier ones of which typically drip water on whatever surface over which they are hung. Furthermore, none is known which provides for a high density of drying clothes in a relatively small floor area. Many require the loosening and/or tightening of fasteners to deploy them in their open positions.

Accordingly, it is a principal object of the present invention to provide a drying rack which is easily portable yet which provides for a high density of drying articles in a relatively small floor area.

It is another object of the invention to provide such a drying rack which is suitable for drying heavy articles such as sweaters without the heavy articles dripping water on the surface on which the dryer is placed.

An additional object of the invention is to provide such a drying rack which may be readily compactly folded.

Yet another object of the invention is to provide such a drying rack which may be deployed in its unfolded position without the need to loosen and/or tighten fasteners.

Other objects of the invention, as well as particular features and advantages thereof, will be elucidated in, or apparent from, the following description and the accompanying drawing figures.

SUMMARY OF THE INVENTION

The present invention accomplishes the above objects, among others, by providing a foldable drying rack having a rectangular midframe with side and end rails and hanging rails extending between the end rails. Hinged, foldable leg members extend downward from the ends of the midframe and provide support without having to loosen and tighten any fasteners. A shelf having hanging rails may be extended between the leg members below the midframe. Hinged, foldable rectangular wingframes, having hanging rails extending between the side rails may extend outward from the ends of the midframe and may also be deployed without having to loosen and tighten any fasteners. The wingframes may also be folded inward toward each other and joined to form a tent-like structure above the midframe. The drying rack may be deployed in its unfolded position without the need to loosen and/or tighten fasteners. In one embodiment, a ratio of almost 10:1 in terms of lineal feet of hanging rails per square foot of floor space is achieved.

DETAILED DESCRIPTION OF THE PREFERRED EMBODIMENTS

Figure 1:
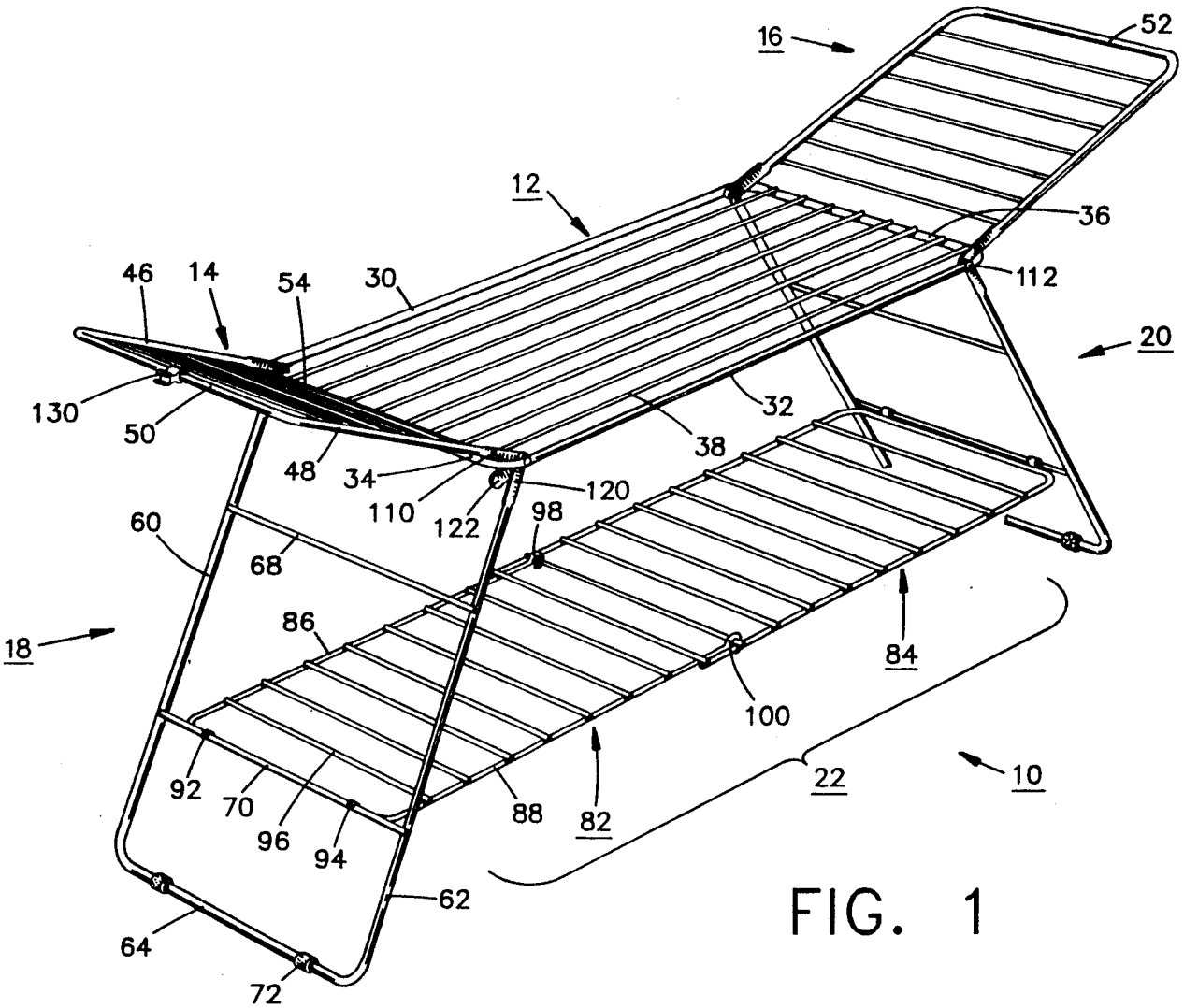
FIG. 1 is a perspective view of the present invention with the wingframes thereof in their outwardly extended position.

Referring now to the Drawing, reference should be had to FIGS. 1–4 together for an understanding of the elements and features of the drying rack of the present invention, generally indicated by the reference numeral 10. Rack 10 includes a midframe, generally indicated by the reference numeral 12, two windframes, generally indicated by the reference numerals 14 and 16, two leg members, generally indicated by the reference numerals 18 and 20, and a shelf assembly, generally indicated by the reference numeral 22.

Midframe 12 is rectilinear in form and includes side rails 30 and 32, end rails 34 and 36, the side and end rails comprising a continuous, unitary member, and hanging rails, as at 38, fixedly attached to and extending between the end rails. It will be understood that it is intended that hanging rails 38 are provided so that wet articles (not shown), such as articles of laundered clothing, may be placed thereover and hung therefrom to allow the articles to dry.

Since wingframes 14 and 16 are identical, except for orientation with respect to midframe 12, only the elements of wingframe 14 will be described. Wingframe 14 includes side rails 46 and 48, end rail 50, the side and end rails comprising a continuous, unitary member, and hanging rails, as at 54, fixedly attached to and extending between the side rails for the placement thereover of wet articles (not shown). (Wingframe 16 includes an end rail 52.)

Likewise, since leg members 18 and 20 are identical, only the elements of leg member 18 will be described. Leg member 18 includes vertical rails 60 and 62 and a horizontal rail 64 which rests on the surface (not shown) upon which rack 10 is placed, the vertical and horizontal rails comprising a continuous, unitary member. Non-skid members, as at 72, may be placed on horizontal rail 64 to prevent rack 10 from sliding on the surface upon which it is placed. Leg member 18 also includes transverse rails 68 and 70 fixedly attached to and extending between vertical rails 60 and 62.

Shelf assembly 22 includes first and second sections, generally indicated by the reference numerals 82 and 84, respectively. First section 82 includes side rails 86 and 88, end rail 90 with downward facing hooks 92 and 94 fixedly attached thereto, and hanging rails, as at 96, for the placement thereover of wet articles (not shown), fixedly attached to and extending between the side rails, the side and end rails comprising a continuous, unitary member. Formed as extensions of the ends of side rails 86 and 88 opposite the ends joined to end rail 90 are downward facing hooks 98 and 100. Second section 84 of shelf assembly 22 is identical to first section 82 except that the side rails of the second section do not terminate hooks. As is shown on FIGS. 2 and 4, shelf assembly 22 is formed by interleaving first and second sections 82 and 84 so that hooks 98 and 100 of the first section engage a selected one of the hanging rails of the second section.

Figure 6:
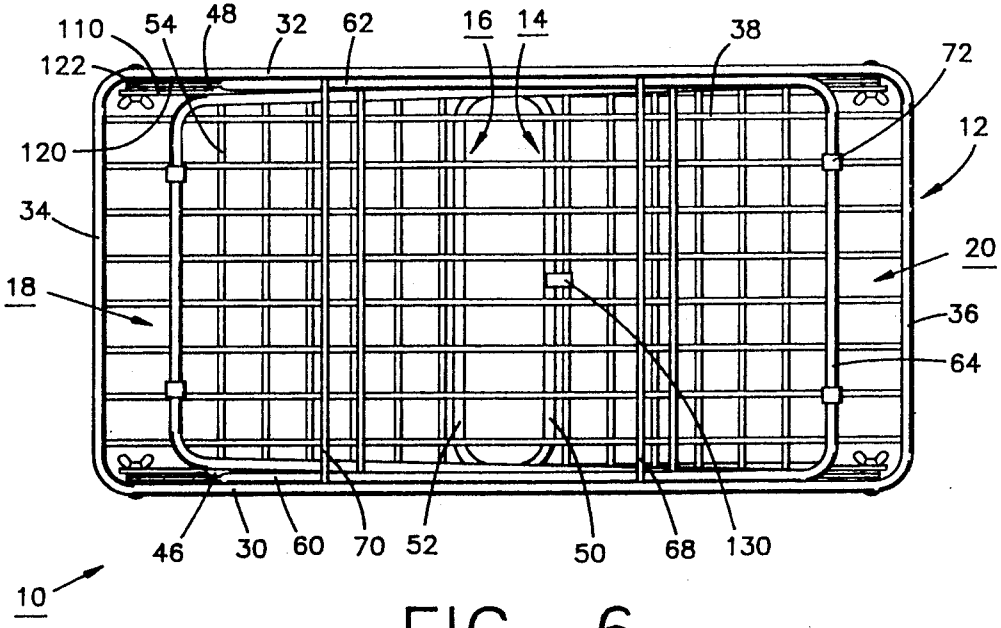
FIG. 6 is a bottom plan view looking up of the present invention in its folded state, without the shelf assembly.
Figure 7:
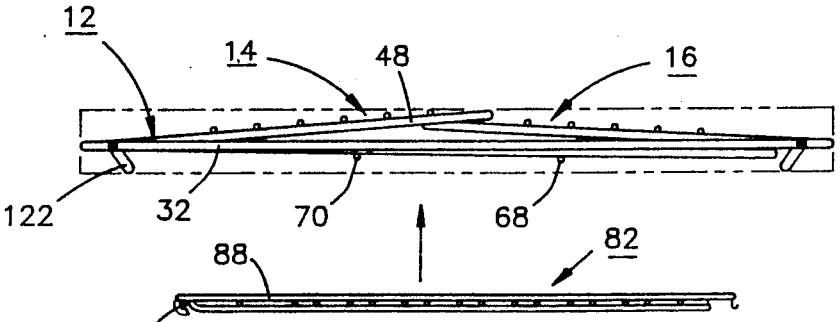
FIG. 7 is a front side elevation view of the present invention in its folded state, with the "folded" position of the shelf assembly indicated.

FIGS. 6 and 7 show rack 10 in its folded state in which state it may be conveniently stored in a closet or other storage area or even under a piece of furniture. It will be understood that rack 10 is placed in its folded state by first removing shelf assembly 22. Then, wingframes 14 and 16 are rotated toward the top of midframe 12 and leg members 18 and 20 are rotated toward the bottom of midframe 12. As can be seen when rack 10 is folded, leg members 18 and 20 nest together so that they both lie flat against the underside of midframe 12. Although leg members 18 and 20 have identical elements, the dimensions thereof are somewhat different and it can be seen that vertical rails 60 and 62 of leg member 18 are spaced apart sufficiently that leg member 20 can nest therebetween. Wingframes 14 and 16 do not so nest, but, when folded, are closely parallel to midframe 12. First and second sections 82 and 84 of shelf 22 fold against each other and may be placed against folded leg members 18 and 20, as indicated on FIG. 7.

When rack 10 is placed in its unfolded state, as shown on FIGS. 1–4, leg members 18 and 20 and wingframes 14 and 16 are rotated relative to the ends of midframe 12. The means by which rotation is effected and by which those members are held in position can be understood by particular reference to FIG. 5 which shows the attachment of vertical rail 62 of leg member 18 and side rail 48 of wingframe 14 to midframe 12. The proximal end of side rail 48 terminates in a flattened portion 110 which is rotatably disposed on a shaft 112 which is fixedly attached to and extends orthogonally inwardly from side rail 32 of midframe 12. It can be seen that wingframe 14 is freely rotatable from its folded position (FIGS. 6 and 7) to its outwardly extended position (FIG. 2), but that, once the wingframe reaches its outwardly extended position, it is prevented from further such rotation by, and is supported in part by, the engagement of flattened portion 110 with the top of end rail 34 of midframe 12. A similar structural arrangement (not shown on FIG. 5) provides for the support of side rail 46.

Similarly, the proximal end of vertical rail 62 of leg member 18 terminates in a flattened portion 120 (See also FIGS. 1 and 2.) which is rotatably disposed on shaft 112 and which flattened portion includes an integral flange 122 extending outwardly therefrom. Vertical rail 62 is freely rotatable from its folded position (FIGS. 6 and 7) relative to midframe 12 until it reaches the position shown on FIG. 2 at which time further rotation is prevented by the engagement of flange 122 with the underside of end rail 34 of the midframe. A similar structural arrangement causes stopping engagement of vertical rail 60 with end rail 32. Thus, with leg member 20 similarly stoppingly engaged with midframe 12, rack 10 may be placed in and maintained in its open position without the need for loosening and/or tightening fasteners.

Flattened portions 110 and 120 are provided for greater strength at the ends of side rail 48 and vertical rail 62, respectively, where the greatest bending moment in those elements occurs.

Figure 5:
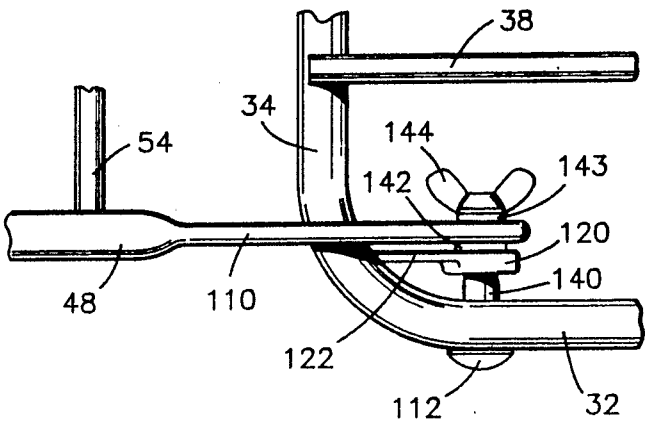
FIG. 5 is a detail showing a joint mechanism of the present invention.

Still referring to FIG. 5, shaft 112 further has disposed thereon a resilient spacer 140 disposed between side rail 32 and flattened portion 120. Shaft 112 also has disposed thereon a first resilient O-ring 142 which is disposed between flattened portions 110 and 120, a second resilient O-ring 143 which is disposed between flattend portion 110, and a locking wing-nut 144 which threadedly engages the end of the shaft and which selectively varies the force required to rotate wingframe 14 and leg member 18 by varying the frictional resistance between the resilient members and the other elements attached to the shaft.

Figure 2:
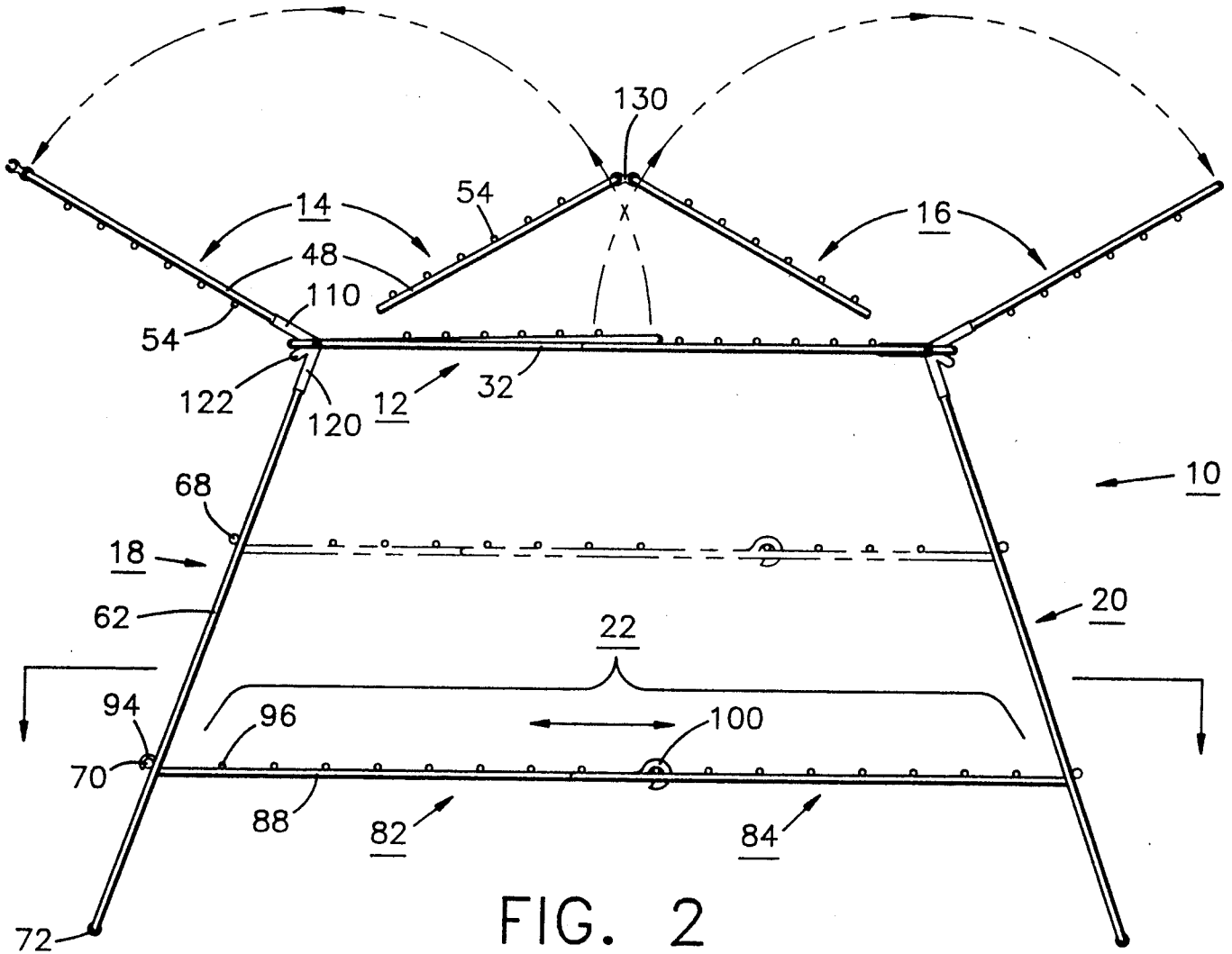
FIG. 2 is a front side elevation view thereof showing the windframes in alternative outwardly or inwardly extended positions.
Figure 3:
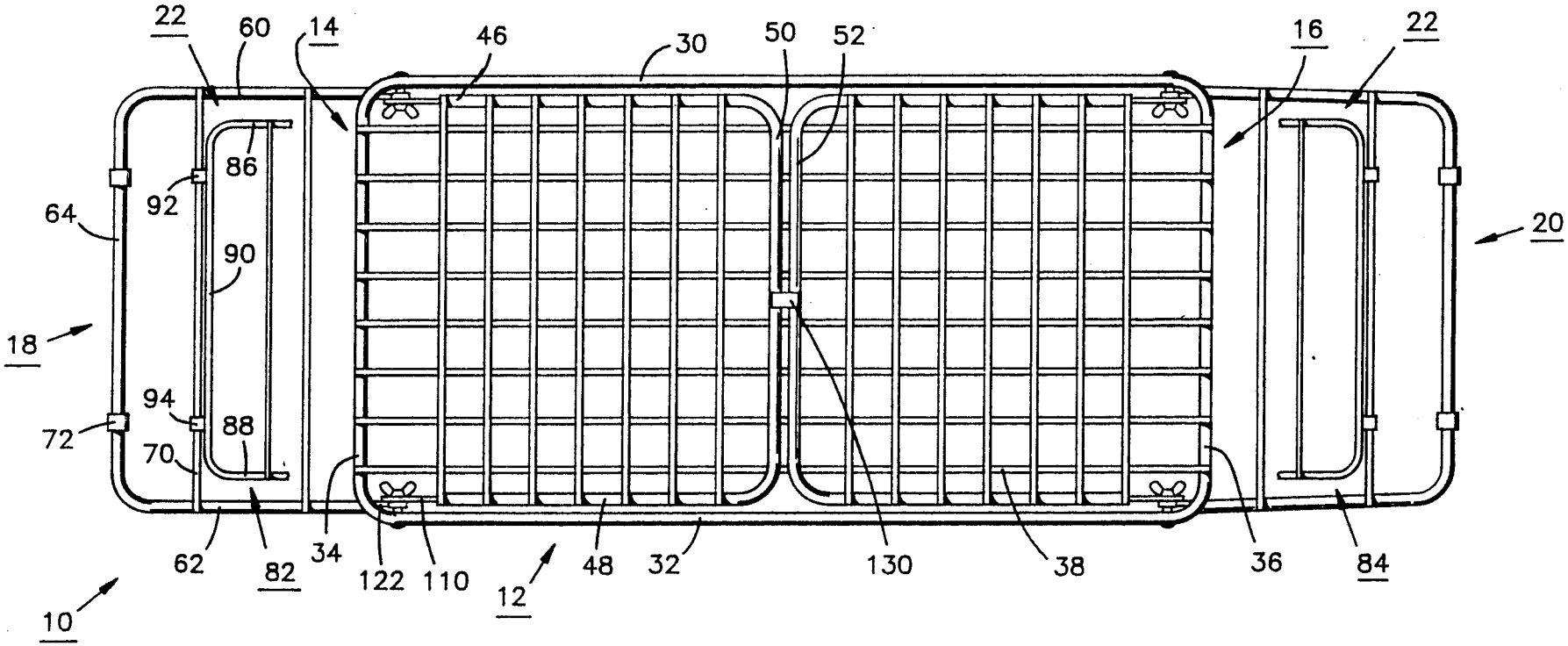
FIG. 3 is a top plan view thereof showing the wingframes in their inwardly extended positions.
Figure 4:
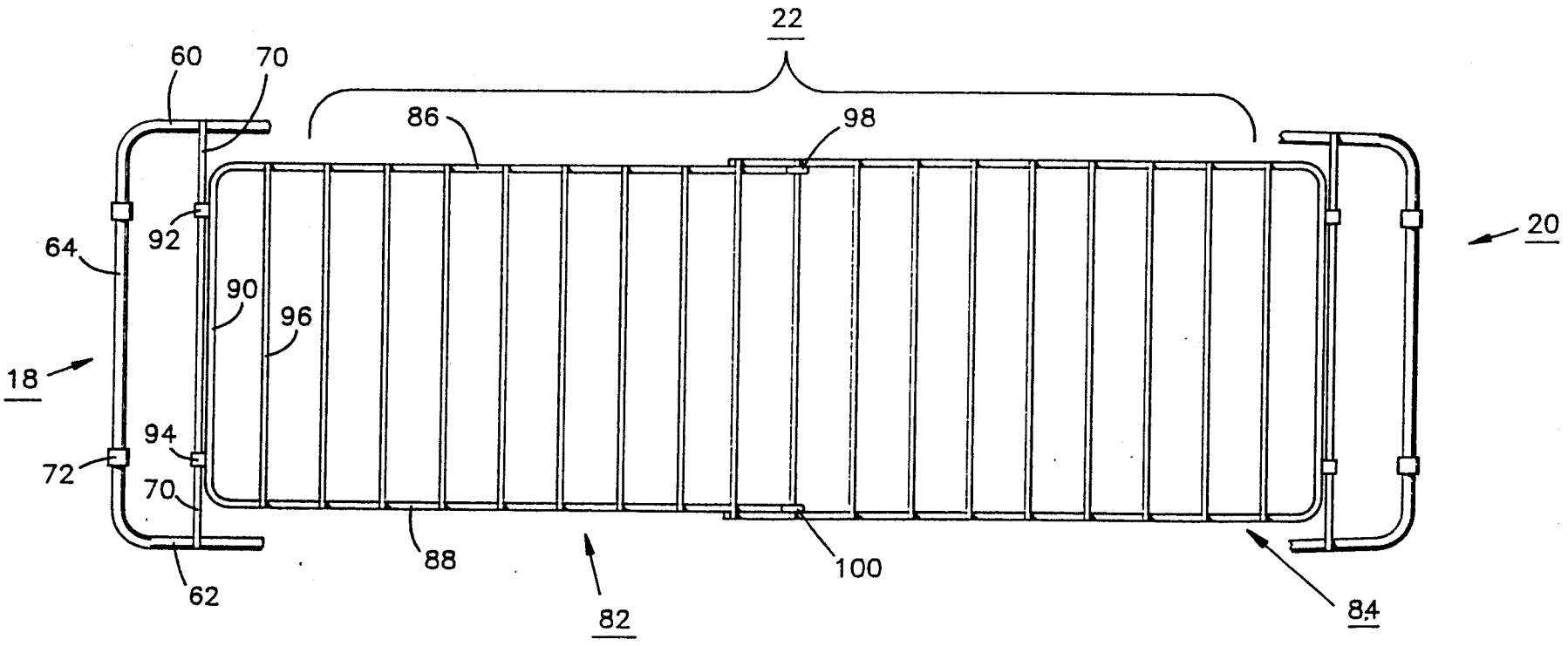
FIG. 4 is a sectional view of FIG. 2 showing a shelf assembly extending between the leg members.

Once leg members 18 and 20 have been placed in their unfolded positions, shelf assembly 22 may be set at an appropriate length and placed so that hooks 92 and 94 are supportingly engaged by transverse rail 70 of leg member 18, as shown in solid lines on FIGS. 2 and 4. The other end of shelf assembly 22 is similarly supported by leg member 20. If desired, shelf assembly 22 can be appropriately shortened and supported by leg members 18 and 20 in the position shown in dashed lines on FIG. 2. In addition to providing additional drying space, shelf assembly 22 also stabilizes rack 10.

Reference again to FIGS. 2 and 3 will aid in understanding how wingframes 14 and 16 are held in their inwardly extended positions. Here, wingframes 14 and 16 have been rotated away from the folded position shown on FIGS. 6 and 7 and then partially rotated toward the folded position such that end rails 50 and 52 are closely spaced apart. A removable, double-ended, resilient clamp 130 is grippingly slipped over the centers of the ends rails and maintains wingframes 14 and 16 in a tent-like form.

As indicated above, wet articles (not shown) may be placed over each of the various hanging rails of rack 10. If desired, wingframes 14 and 16 may be placed in their inwardly extended, or tent-like, positions and an article such as a heavy sweater, for example, may be placed thereon. A towel or other absorbent article may then be placed on mid frame 12 to prevent any water dripping from the sweater from falling on the floor or on other articles hanging from the midframe or shelf assembly 22.

In an embodiment of the present invention in its fully open position with shelf assembly 22 in its lower position, with the relative dimensions shown, and having a "footprint" measuring 22 inches by 76 inches, 110 linear feet of hanging rails are provided, thus giving a ratio of almost 10:1 in terms of linear feet per square foot. That rack, when in its folded position, as shown on FIGS. 6 and 7, occupies a volume measuring only 2½ inches by 22 inches by 41½ inches.

For the above embodiment, it has been found that the side and end rails of the midframe and the wingframes and the rails of the leg members can be satisfactorily manufactured from 10-mm diameter steel pipe and the other rails from 5/32-inch steel dowells, with welded points of attachment. Preferably, all rail members are dip-coated with PVC or painted by electrostatic painting with a suitable paint.

It will thus be seen that the objects set forth above, among those made apparent from the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A drying rack, comprising:

(a) a midframe having disposed thereacross a plurality of hanging rails;

(b) leg members having upper ends rotatably attached to said midframe, said leg members being rotatable from a folded position to an open position;

(c) flange means fixedly attached to said upper ends of said leg members to engage said midframe, such that said rotation to said open position is terminated by, and said legs are held in said open position by, said engagement when said rack is placed on a supporting surface; and (d) means to selectively adjust the rotating friction of said leg members, said means to selectively adjust comprising resilient spacers disposed between said upper ends and said midframe, said resilient spacers being adjustably compressable to selectively vary the sliding friction between said upper ends and said midframe;

whereby, said leg members may be placed in said open position and said rack supported by said surface, without the loosening and/or tightening of fasteners.

2. A drying rack, as defined in claim 1, wherein, when said leg members are in said folded position, said leg members nest and lie against and parallel to said midframe.

3. A drying rack, as defined in claim 1, further comprising a shelf disposed between said leg members, said shelf having disposed thereacross a plurality of hanging rails.

4. A drying rack, as defined in claim 3, wherein, said shelf is foldable and, when said leg members are in said folded position, said leg members nest and lie against and parallel to said midframe and said shelf may be folded to lie against and parallel to said leg members.

5. A drying rack, comprising:

(a) a midframe having disposed thereacross a plurality of hanging rails;

(b) leg means to support said midframe;

(c) at least one wingframe having a plurality of hanging rails disposed thereacross, said wingframe being rotatable from a folded position to an outwardly open position, such that said rotation to said open position is terminated when members of said wingframe engage members of said midframe; and (d) means to selectively adjust the rotating friction of said at least one wingframe, said means to selectively adjust comprising resilient spacers disposed between said at least one wingframe and said midframe, said resilient spacers being adjustably compressable to selectively vary the sliding friction between said at least one wingframe and said midframe;

whereby, said wingframe may be placed and maintained in said outwardly open position without the loosening and/or tightening of fasteners.

6. A drying rack, as defined in claim 5, wherein:

(a) said drying rack has two wingframes and said two wingframes may be rotated from said outwardly open position to an inwardly open position wherein end members of said two wingframes are closely spaced apart, such that said two wingframes define a tent-like structure above said midframe; and (b) means to releasably maintain said wingframes in said inwardly open position.

7. A drying rack, as defined in claim 5, wherein, when said at least one wingframe is in said folded position, said at least one wingframe lies closely parallel to said midframe.

8. A drying rack, as defined in claim 6, wherein, when said two wingframes are in said folded position, said two wingframes lie closely parallel to said midframe.

9. A drying rack, comprising:

(a) a rectangular midframe having a pair of oppositely disposed side rails and a pair of oppositely disposed end rails attached to said side rails at the ends thereof, said midframe having disposed between a pair of said rails a plurality of hanging rails;

(b) leg members each having a pair of vertical rails, with upper and lower ends, and a horizontal rail attached to said lower ends, said upper ends being rotatably attached to said midframe, said leg members being rotatable from a folded position to an open position;

(c) flange means fixedly attached to said upper ends of said leg members to engage said midframe, such that said rotation to said open position is terminated by, and said legs are held in said open position by, said engagement when said rack is placed on a supporting surface; and (d) two rectangular wingframes, each said wingframe having two oppositely disposed side rails with plurality of hanging rails disposed thereacross and an end rail attached to the distal ends of said side rails, the proximal ends of said two wingframes being rotatably attached to said side rails of said midframe, said two wingframes being rotatable from a folded position to an outwardly open position, such that said rotation to said outwardly open position is terminated when a portion of said side rails of said wingframes near the proximal end thereof engages said end rails of said midframe;

(e) said two wingframes may be rotated from said outwardly open position to an inwardly open position wherein said end rails of said two wingframes are closely spaced apart, such that said two wingframes define a tent-like structure above said midframe;

(f) means to releasably maintain said wingframes in said inwardly open position; and (g) a shelf disposed between transverse rails of said leg members, said shelf having disposed thereacross a plurality of hanging rails, said shelf comprising:

(i) first and second rectilinear sections;

(ii) said first section comprises a pair of oppositely disposed side rails having attached to first ends of said side rails an end rail and having disposed between said side rails a plurality of hanging rails, the other ends of said side rails terminating in downward facing hooks;

(iii) said second section comprises a pair of oppositely disposed side rails having attached to first ends of said side rails an end rail and having disposed between said side rails a plurality of hanging rails;

(iv) said first and second sections being interleavable and removably attached to each other by means of said hooks of said first section engaging one of said hanging rails of said second section; and (v) means to releasably attach said end rails to said transverse rails of said leg members.

10. A drying rack, as defined in claim 9, wherein, when said leg members are in said folded position, said leg members nest and lie against and parallel to said midframe.

11. A drying rack, as defined in claim 9, wherein, when said two wingframes are in said folded position, said two wingframes lie closely parallel to said midframe.

12. A drying rack, as defined in claim 9, further comprising a shelf disposed between transverse rails of said leg members, said shelf having disposed thereacross a plurality of hanging rails.

13. A drying rack, as defined in claim 9, further comprising means to selectively adjust the rotating friction of said leg members and said wingframes.

* * * * *